US005699762A

United States Patent [19]

Horiuchi

[11] Patent Number: 5,699,762

[45] Date of Patent: Dec. 23, 1997

[54] VALVE OPERATING SYSTEM FOR INTERNAL COMBUSTION ENGINE

[75] Inventor: Shigeaki Horiuchi, Fujisawa, Japan

[73] Assignee: Isuzu Motors Limited, Tokyo, Japan

[21] Appl. No.: 574,024

[22] Filed: Dec. 18, 1995

[30] Foreign Application Priority Data

Dec. 16, 1994 [JP] Japan ..... 6-334130

[51] Int. Cl.[6] ..... F01L 1/26

[52] U.S. Cl. ..... 123/90.22; 123/90.39; 123/188.3

[58] Field of Search ..... 123/90.22, 90.23, 123/90.39, 90.4, 90.42, 90.44, 188.3, 188.9, 188.11

[56] References Cited

U.S. PATENT DOCUMENTS

| | | | |
|---|---|---|---|
| 2,162,063 | 6/1939 | Crawford | 123/188.3 |
| 3,422,805 | 1/1969 | Dzianott | 123/188.14 |
| 4,327,677 | 5/1982 | Vander Bok | 123/90.22 |
| 4,944,257 | 7/1990 | Mills | 123/90.39 |
| 5,054,440 | 10/1991 | Kadokawa | 123/90.39 |
| 5,410,995 | 5/1995 | Bentz et al. | 123/90.22 |

FOREIGN PATENT DOCUMENTS

| | | | |
|---|---|---|---|
| 5-92406 | 12/1993 | Japan . | |
| 132070 | 9/1919 | United Kingdom | 123/90.22 |

*Primary Examiner*—Weilun Lo
*Attorney, Agent, or Firm*—Spencer & Frank

[57] ABSTRACT

In a valve operating system for an internal combustion engine in which two valves are simultaneously operated by one valve bridge, a roller is fitted to one end of a rocker arm 1, said roller pushing the valve bridge downward. A transverse force produced by the circular motion of the rocker arm merely causes rolling of the roller and is not delivered as a force of moving the valve bridge in the transverse direction. Thus, the valve bridge does not require any guiding mechanism for resisting against the transverse force. In addition, the depression bottom of each of the sleeves of the valve bridge is shaped flat, and the stem end of the valve in contact with the depression bottom is shaped spherical so as to contact the stem and with the depression bottom at one point on the spherical surface. Thus, even when a certain level difference is produced between the stem ends of valves, the contacting manner is not changed except that the contact point migrates to other point and, therefore, no level difference-removing means such as an adjuster are required.

2 Claims, 2 Drawing Sheets

VALVE OPERATING SYSTEM FOR INTERNAL COMBUSTION ENGINE

FIELD OF THE INVENTION

This invention relates to a valve operating system for an internal combustion engine in wich two valves are simultaneously operated by one valve bridge.

CROSS-REFERENCE TO RELATED APPLICATION

This application claims the priority benefits of Japanese patent application number 6-334130, filed Dec. 16th, 1994, the disclosure of which is incorporated herein by reference.

BACKGROUND OF THE INVENTION

In some valve operating systems for large Diesel engines, two valves are simultaneously operated by one valve bridge pushable downward by a rocker arm. Since the rocker arm makes a circular motion with its rocker shaft as its center, it pushes downward the valve bridge at the top surface of the bridge while slightly scrubbing the surface in the transverse direction. Therefore, when pushed downward, the valve bridge suffers a force in the transverse direction as well as a force in the downward direction.

In order to prevent the valve bridge from leaning because of the transverse force, it has so far been conducted to provide a guiding mechanism for guiding the bridge downward. However, a guiding mechanism provided in the central portion of the valve operating system requires a larger space and makes the valve operating system heavier. Hence, many improvements for solving this problem have been proposed. One of such proposals is described in Japanese Unexamined Utility model Publication No. 5-92406, which is described below.

FIG. 5 illustrates the aforesaid conventional valve operating system. In FIG. 5, numeral 1 designates a rocker arm, 2 a bushing, 3 a rocker shaft, 4 a valve bridge, 4-1 and 4-2 sleeves, 5 a nut, 6 an adjuster, 7 and 8 depressions, 9 a stopper, 10 and 11 valves, 12 and 13 cotters, 14 and 15 spring shoes, and 16 and 17 springs.

One end of the rocker arm 1 shown makes a circular motion with the rocker shaft 3 as its center to periodically push down the valve bridge 4, since the other end of the rocker arm 1 (not shown) is driven by a cam. Two sleeves 4-1 and 4-2 of the valve bridge 4 are respectively fitted to the stem ends of valves 10 and 11 and push them down to open the valves of an internal combustion engine. When the downward force by the rocker arm 1 disappears, the valves return to their initial positions by the biasing force of the springs 16 and 17. The stem end of the valve 11 is fixed by the stopper 9, whereas the stem end of the valve 10 is adjustably fitted by the adjuster 6 and the nut 5. Where there occurs a difference in level between the valves 10 and 11 in the downward pushing direction, the difference is removed by adjusting the adjuster 6 to thereby push down the two valves at the same time.

In this valve operating system, one sleeve 4–2 has a longer length than the other sleeve so as to also function as a conventional guiding mechanism. Therefore, it eliminates the necessity of providing an exclusive guiding mechanism.

However, the aforesaid conventional valve operating system for internal combustion engine has the following problems.

A first problem is that, though no exclusive guiding mechanism is provided, one of the sleeves of the valve bridge must have a longer length with enough strength to also function as a guiding mechanism.

A second problem is that an adjuster is necessary for removing the level difference between the two valves.

The first problem is described in more detail below. Since the rocker arm transversely scrubs the top portion of the bridge upon pushing downward the valve bridge, a transverse force also acts on the bridge. Thus, some guiding mechanism is still required somewhere, though an exclusive guiding mechanism is omitted, for resisting the transverse force and, as long as the aforesaid transverse force exists, there arises non-uniform abrasion at a portion resisting the force (specifically, the portion where the sleeve 4-2 is fitted to the valve 11 as shown in FIG. 5). The non-uniform abrasion leads to premature mechanical error.

The second problem is described in more detail below. The stem end of the valve 11 has a flat face which is in contact with the stopper 9. The stem end of the valve 10 also has a flat face which is in contact with the adjuster 6. When some difference in level appears between the stem ends, the valve bridge leans somewhat and, as a result, respective stem ends come into contact with the stopper or the adjuster not at the whole flat face but at only part of it, which causes the non-uniform abrasion.

SUMMARY OF THE INVENTION

The valve operating system for an internal combustion engine capable of operating two valves simultaneously by one valve bridge, according to the present invention, has the valve bridge having no guiding mechanism for avoiding leaning of the bridge upon pushing downward, and has a rocker arm equipped with a roller at one end at which it contacts with said valve bridge.

Another aspect of the valve operating system of the present invention for an internal combustion engine capable of operating two valves simultaneously by one valve bridge is that the depression bottom of the sleeve of the valve bridge is made flat, with the stem end of the valve fitted to the sleeve being made spherical.

DETAILED DESCRIPTION OF THE INVENTION

Since a roller is fitted to one end of the rocker arm to push down the valve bridge by the roller, a transverse force possibly produced by the circular motion of the rocker arm end is merely used for rolling the roller and is not delivered as a force for moving the valve bridge in the transverse direction with respect to the downward direction. Therefore, no guiding mechanism is required for resisting the transverse force, which serves to reduce the size and weight of the valve operating system.

In addition, since the depression bottom of the sleeve of the valve bridge is made flat and the stem end of the valve engagedly fitted to the sleeve is made spherical so as to contact the stem end of the valve with the depression bottom at one point of the spherical surface, only the contact point between the depression bottom and the stem end is changed to another point on the spherical surface, thus no level difference-adjusting means such as an adjuster is required.

BEST MODE FOR PRACTICING THE INVENTION

Figure 1:
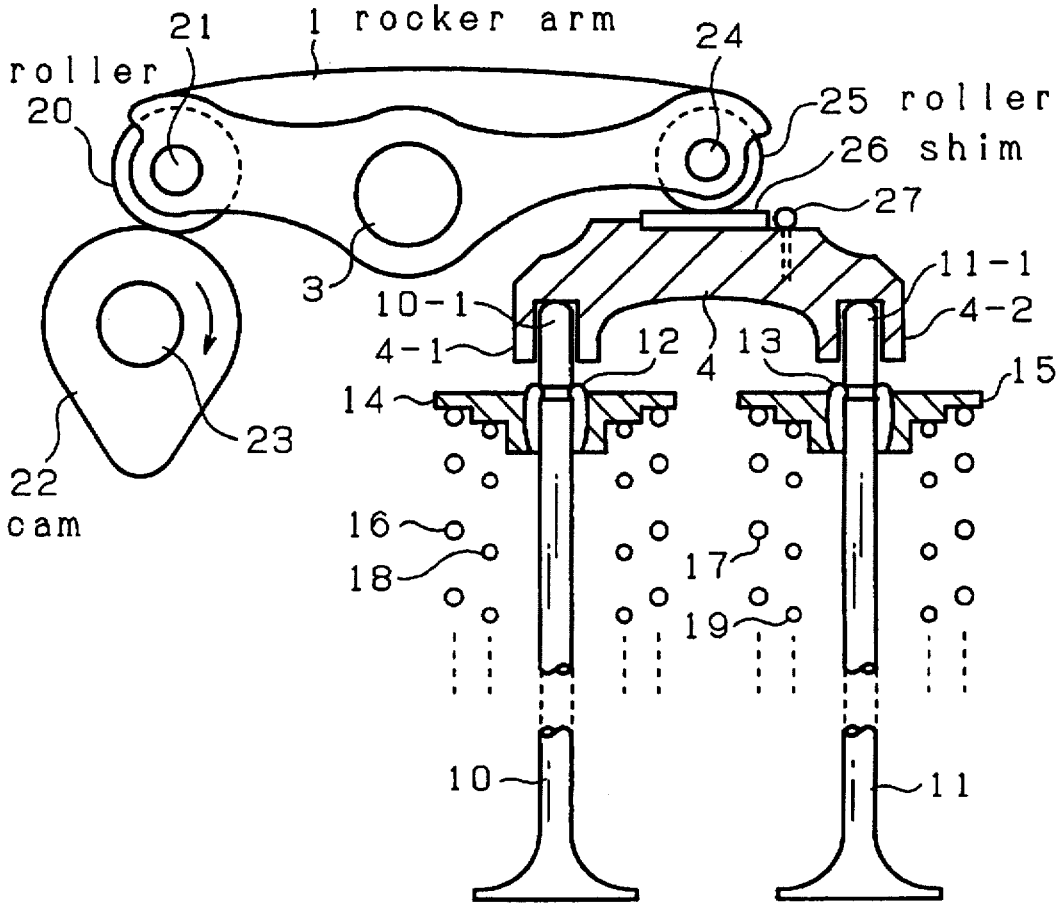
FIG. 1 illustrates a valve operating system of the present invention for an internal combustion engine.

An example of the present invention is described in detail by reference to the drawings. FIG. 1 illustrates a valve operating system in accordance with the present invention for an internal combustion engine, wherein labels correspond to those in FIG. 5, with numerals 18 and 19 designating springs, 20 a roller, 21 a roller shaft, 22 a cam, 23 and 24 cam shafts, 25 a roller, 26 a shim, and 27 a stopping pin.

Figure 4:
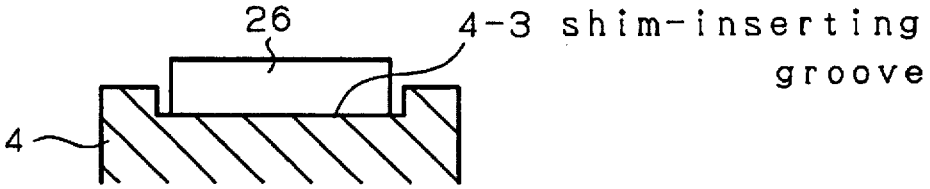
FIG. 4 is a cross-sectional view of a shim viewed from the inserting side.

The roller 20 on the roller shaft 21 is fitted, in contact with the cam 22, to one end of the rocker arm 1. To the other end of the rocker arm 1 is fitted the roller 25 fixedly provided on the cam shaft 24. The shim 26 is slid in the transverse direction (from the right side in FIG. 1) into the top portion of the valve bridge 4 in contact with the roller 25 of the rocker arm 1, with the stopping pin 27 being inserted at the back end of the shim to prevent the shim from coming off. FIG. 4 illustrates the shim 26 from the inserting side (i.e., from the side of the stopping pin 27), in which 4-3 designates a shim-inserting groove provided on top of the valve bridge 4. The shim is used for adjusting a gap.

The sleeves 4-1 and 4-2 of the valve bridge 4 are the same length and are not so long as to also function as the guiding mechanism but have a usual enough length to keep the engagement with the valve. The valve stem ends 10-1 and 11-1 are shaped in a spherical form with a large curvature.

When the roller 20 is pushed by the rotated cam 22, the rocker arm 1 makes a circular motion with the rocker shaft 3 as its center, and the roller 25 fitted to the other end pushes the valve bridge 4 downward. Thus, valves 10 and 11 are also pushed downward. When the pushing force disappears, the valves 10 and 11 and the valve bridge 4 return to their initial positions by the upward biasing force of the springs 16 to 19.

When a transverse force acts upon the roller 25 pusing the valve bridge downward, the roller 25 rolls on the shim 26 while pushing downward. Since the roller 25 does not transversely scrub the surface of the shim 26 while pusing downward, no transverse force is delivered to the valve bridge 4. Accordingly, guiding mechanisms for resisting the transverse force are not necessary as is different from the prior art.

Figure 2:
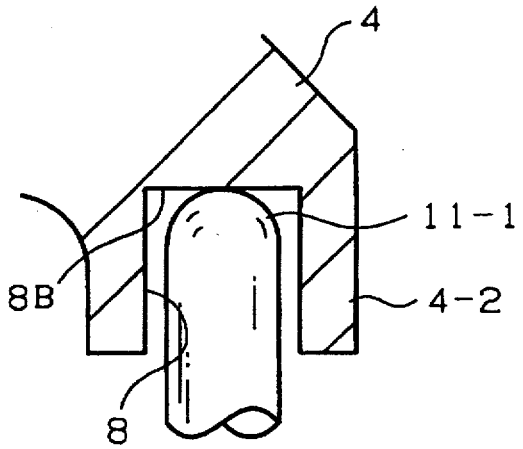
FIG. 2 is an enlarged view of a sleeve and a stem end of a valve.

FIG. 2 is an enlarged view of the sleeve and the stem end, illustrates the sleeve 4-2, but the same applies to the sleeve 4-1. Labels correspond to those in FIG. 1, with numeral 8 designating a depression, and 8B a depression bottom. The stem end 11-1 of the valve comes into contact with the depression bottom 8B of the depression 8 at one point on the spherical surface. Additionally, the depression bottom 8B is desirably subjected to a hardening treatment.

Figure 3:
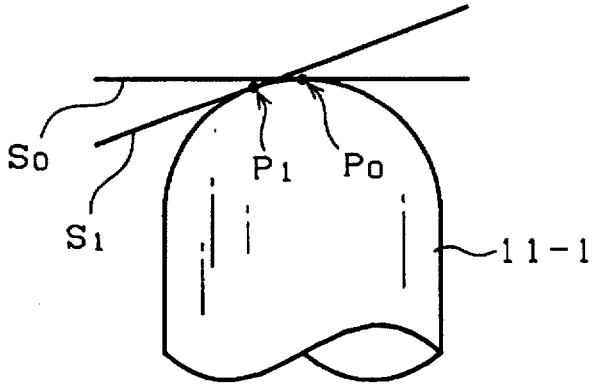
FIG. 3 illustrates a contacting state of the valve stem end with the depression bottom of the sleeve in the present invention.

FIG. 3 illustrates the contacting manner between the stem end of the valve and the depression bottom of a sleeve. $S_0$ designates a horizontal depression bottom 8B when there is no level difference between the stem ends 10-1 and 11-1 of the two valves. $S_1$ designates a leaned depression bottom 8B when there are a certain level difference between the two stem ends. In the case of $S_0$, the contact point is $P_0$ whereas, in the case of $S_1$, the contact point is $P_1$. Even when a level difference is generated to lean the valve bridge 4, the contacting manner does not change at all except for the contact point, thus non-uniform abrasion never takes place.

Figure 5:
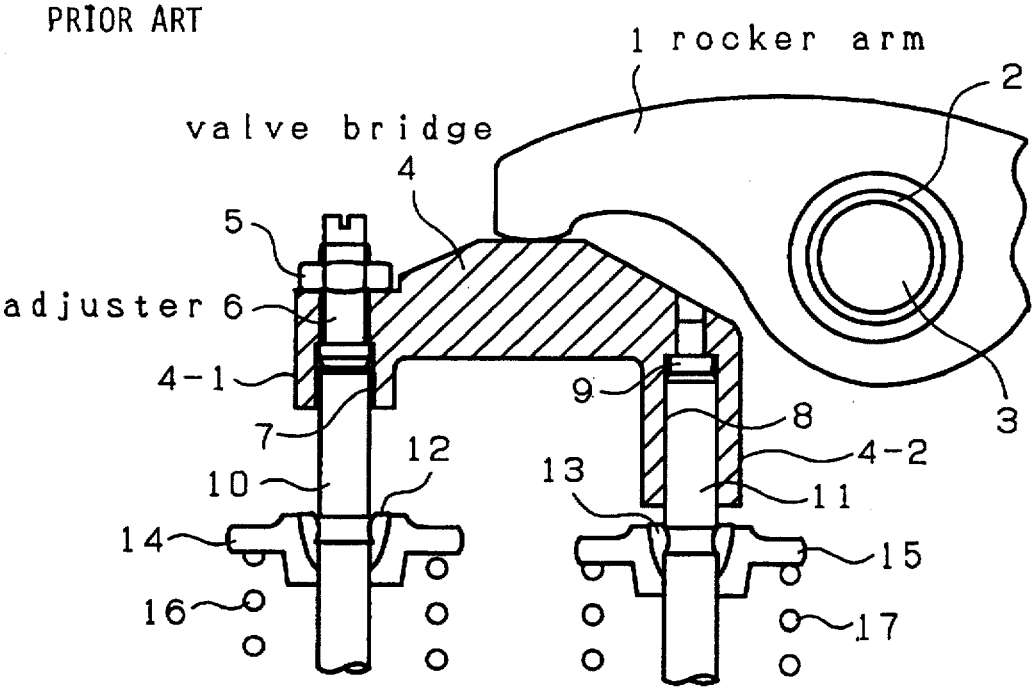
Fig. 5 PRIOR ART
FIG. 5 illustrates a conventional valve operating system.

As is described above, the leaned valve bridge 4 may be left in the leaned state, and hence adjusting means for removing the level difference such as an adjuster 6 shown in FIG. 5 is not necessary.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A valve operating system for an internal combustion engine, comprising:

two valves;

a valve bridge which operates the two valves;

a rocker arm having first and second ends; and a roller fitted to the first end of the rocker arm in contact with the valve bridge, wherein the two valves each have a stem end, wherein the valve bridge has two sleeves each including a depression which has a flat bottom, and wherein the stem end of each valve is spherical and is engagedly fitted to the flat bottom of one of the respective sleeves.

2. A valve operating system for an internal combustion engine, comprising:

two valves each having a valve stem end;

a valve bridge which operates the two valves and which has two sleeves of equal length which engage respective valve stem ends, the length of the sleeves being sufficient to maintain engagement of the valve stem ends without providing a downward guiding mechanism;

a rocker arm having first and second ends; and a roller fitted to the first end of the rocker arm in contact with the valve bridge, whereby downward movement of the rocker arm pushes the roller but delivers no transverse the valve bridge, wherein each sleeve of the valve bridge includes a depression which has a flat bottom, and wherein the stem end of each valve is spherical and is engagedly fitted to the flat bottom of one of the respective sleeves.

* * * * *